United States Patent [19]

Raaijmakers et al.

[11] Patent Number: 5,031,666

[45] Date of Patent: Jul. 16, 1991

[54] CLOTH BEAM CHANGER WITH RESILIENT TRANSMISSION LINK ON GRIPPING ARM

[75] Inventors: Tonny Raaijmakers; Christian Huguenin, both of Winterthur, Switzerland

[73] Assignee: Sulzer Brothers Limited, Winterthur, Switzerland

[21] Appl. No.: 471,928

[22] Filed: Jan. 29, 1990

[30] Foreign Application Priority Data

Feb. 15, 1989 [CH] Switzerland ..... 521/89

[51] Int. Cl.[5] ..... D03D 49/00

[52] U.S. Cl. ..... 139/1 R; 242/66; 242/58.3; 28/201; 414/911

[58] Field of Search ..... 139/1 R, 67.1 R, 66, 139/65, 78.7, 79, 291 R; 242/58.3, 58.4, 58.2; 28/201, 208; 414/458, 459, 911

[56] References Cited

U.S. PATENT DOCUMENTS

| | | | |
|---|---|---|---|
| 4,606,381 | 8/1986 | Suwa | 139/1 R |
| 4,892,119 | 1/1990 | Hugo et al. | 139/1 R |
| 4,910,837 | 3/1990 | Fujimoto et al. | 139/1 R |

FOREIGN PATENT DOCUMENTS

| | | | |
|---|---|---|---|
| 0296113 | 12/1988 | European Pat. Off. . | |
| 0296114 | 12/1988 | European Pat. Off. . | |
| 0296115 | 12/1988 | European Pat. Off. . | |
| 2417476 | 10/1975 | Fed. Rep. of Germany . | |
| 1206332 | 2/1960 | France . | |
| 2184149 | 8/1987 | Japan | 28/201 |
| 2206066 | 9/1987 | Japan | 28/201 |

*Primary Examiner*—Andrew M. Falik

*Attorney, Agent, or Firm*—Kenyon & Kenyon

[57] ABSTRACT

A cloth beam changer includes a conveyor having gripping arms which carry gripping elements at the ends. A transmission is provided in the form of a slide with a spindle and nut arrangement for raising and lowering the slide. A guide rail and stop are provided in the winding-on station of the loom to position the gripping elements accurately while at the same time preventing further downward movement of the gripper arms and slide. A spring between the slider and spindle nut compressers should the transmission overshoot the position of the gripper elements. A second spring is also provided between two parts of the gripper arm to permit deflection of the lower part upon engagement and sliding on the guide rail of the loom. Sensors are provided to measure the amount of deflection of the respective springs.

20 Claims, 3 Drawing Sheets

CLOTH BEAM CHANGER WITH RESILIENT TRANSMISSION LINK ON GRIPPING ARM

This invention relates to a cloth beam changer for a loom.

Heretofore, various types of cloth beam changing devices have been known, for example as described in French Patent 1,206,332, German OS 24 17 476 and U.S. Pat. No. 4,606,381. Generally, such changers are constructed to remove a full cloth beam from a loom while replacing the full cloth beam with a fresh empty beam.

European Patent Applications 0 296 113, 0 296 114 and 0 296 115 describe other types of changers in which an automatic exchange can take place between a loom and a beam changer.

Generally, depending upon the level of automation, cloth beam changing usually proceeds under either a manual or automatic control. One characteristic feature associated with the conveyance of very heavy cloth beams between work stations is that the changers are provided with gripping arms having gripping elements at the ends. In such cases, the gripping elements serve to grip the cloth beams in order to position the beams in stations both inside and outside the changer, the range of the arms and the position of the stations being adapted to one another. An important function of the gripping arms is to position the gripping elements accurately in order to receive the cloth beams and to position the beams accurately in the various stations. Only slight dimensional variations of the cloth beams themselves and in the positioning of the changer relative to the loom can therefore be permitted. In the automated start-up of end positions, inching and sensors at the stations are necessary in the final phase in order to confirm the required end position, or else very stringent requirements must be observed as regards the accuracy of the relative positions between the changer and the work station. Both of these concepts are expensive.

Accordingly, it is an object of the invention to accurately position the gripping elements of a cloth beam changer in a relatively simple manner.

It is another object of the invention to accurately position the gripping elements of a cloth beam changer and cloth beams in particular work stations with a relatively simple structure.

Briefly, the invention provides a cloth beam changer for a loom which includes a mobile conveyor, a pair of gripping arms mounted on the conveyor with each arm having gripping elements for gripping a beam therebetween, transmission means mounted on the conveyor for moving the gripping arms into a position for gripping a beam in the gripping elements and resilient transmission links disposed in the transmission means for deflecting in response to preset limit forces being exceeded during positioning of the gripping arms into the gripping position. In this respect, the loom is provided with a cloth winding-on station having a guide rail and a stop which serve to define the limits of movements for the gripping arms.

One of the advantages of the cloth beam changer is that the proposed end positions are respected, despite relatively large variations in the relative position between the conveyor and the work station as long as the start-up of the work station is programmed from the direction and within the resilience of the transmission links and the permissible deformation travels of the resilient transmission links are not exceeded. Also, overshooting the permissible deformation travel due to an unforeseen obstacle leads to a stoppage without damage. Further, not exceeding the permissible deflection indicates the probability that the proposed end position has not been reached. That is, the gripping arm can be actuated in an open control chain in the range of permissible deflection and the exactly intended position can be reached despite inaccuracy in the relative positioning of the conveyor relative to the work station.

Since relatively substantial positioning inaccuracies are tolerable, simpler and cheaper systems can be used to position and support the conveyor on the loom. The resilient transmission links may also be used in the same way in the transmission means of a changer for changing the loom harness and/or the warp beam and with facilities for changing bobbins or groups thereof.

These and other objects and advantages of the invention will become more apparent from the following detailed description taken in conjunction with the accompanying drawings wherein:

FIG. 1 diagrammatically illustrates a cloth beam changer in accordance with the invention positioned relative to the loom;

Figure 1:
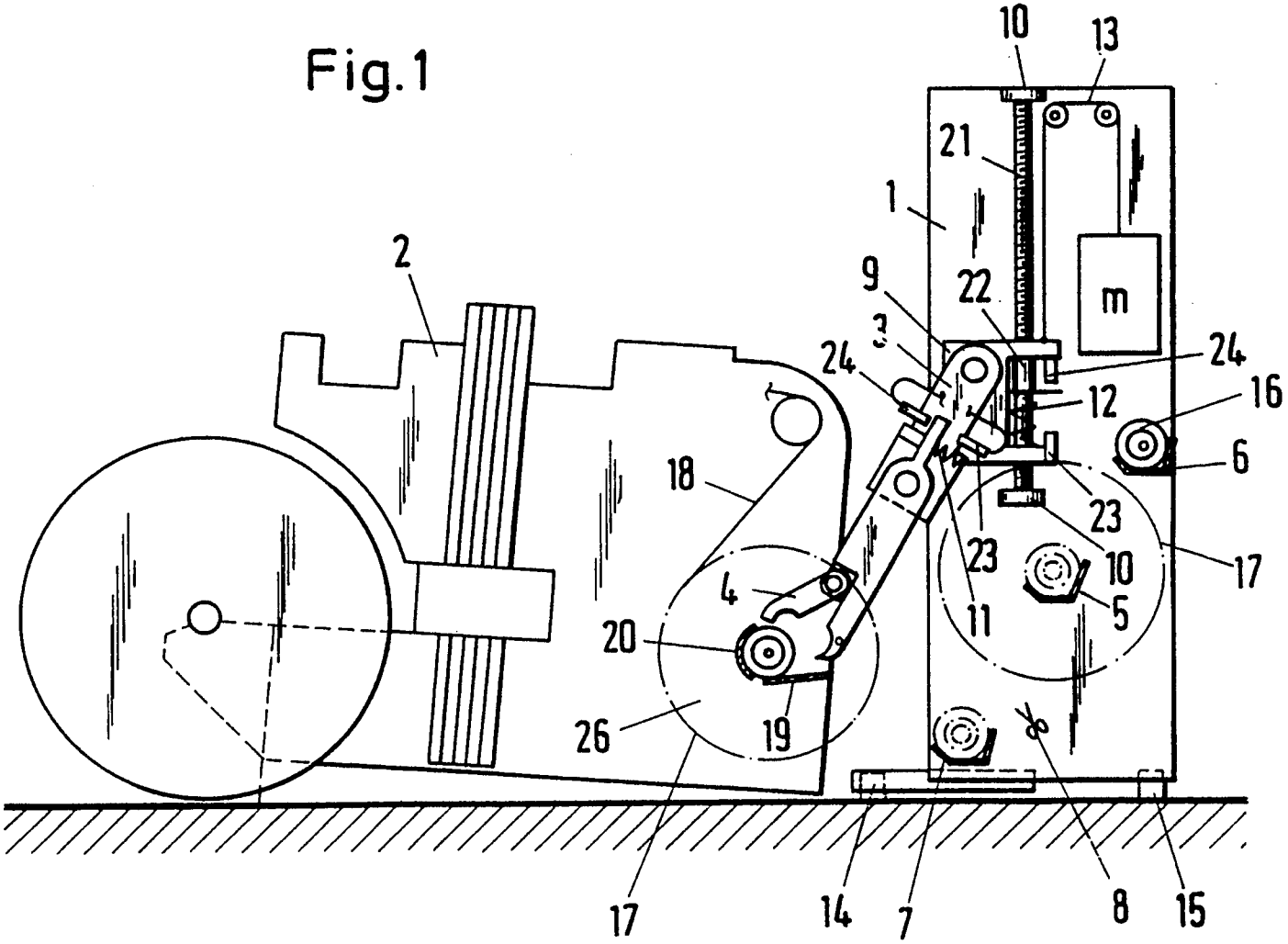

Referring to FIG. 1, the cloth beam changer is of mobile construction so as to be moved into a location astride a loom 2.

As illustrated, the cloth beam changer has a conveyor 1 having a pair of gripping arms 3 mounted therein with each arm 3 having gripping elements 4 for gripping a beam therebetween. In addition, a means 5 is provided within the frame of the conveyor 1 in order to receive a full cloth beam 17 thereon while a separate means 6 is provided for receiving an empty cloth beam 16. In addition, a cloth wind-on means 7 is provided for the manipulation of a cloth during a cloth beam exchange as is known. Likewise, a cloth cutter 8 is provided adjacent to the cloth wind-on means 7.

Referring to FIG. 1, the loom 2 includes a cloth winding-on station 26 in which a cloth 18 is wound to form a full cloth beam 17. As indicated, the winding-on station 26 includes a guide rail 19 and a stop 20 which will be further explained below.

Referring to FIG. 1, the cloth beam changer includes a pair of supports 10 which are fixedly mounted on the conveyor 1 while a rotatable lead screw 21 extends vertically between the supports 10. In addition, a nut 22 is threadably mounted on the lead screw 21.

Figure 2:
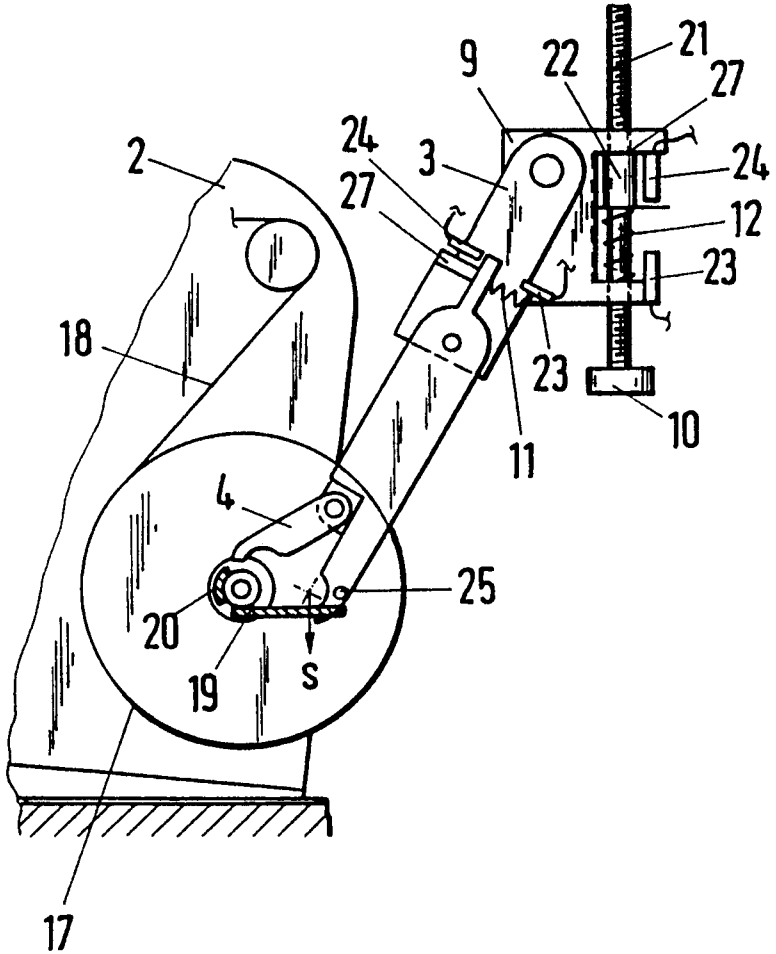
FIG. 2 illustrates a diagrammatic partial view of the changer with a gripping arm immediately before contact is made with a guide rail on the loom for the full cloth beam.

Referring to FIG. 2, a slide 9 is mounted on the lead screw 21 with the lead screw 21 passing through suitable apertures in the slide 9. As illustrated, the slide 9 has a pair of ears or flanges through which the lead screw 21 passes in non-rotatable relation while the nut 22 is longitudinally guided in the slide 9 as by a pin or shoulder (not shown). The upper ear or flange rests on the nut 22 such that upon rotation of the-lead screw 21, the nut 22 which is held against rotation by the pin or shoulder may be raised or lowered vertically so as to raise or lower the slide 9 therewith. As also indicated, each gripper arm 3 is pivotally mounted on the slide 9 via a suitable pivot pin or the like. The lead screw 21, nut 22 and slide 9 thus serve as a transmission means mounted on the conveyor 1 for moving the gripper arms 3 into a position for gripping a beam 17 in the gripping elements 4.

As illustrated in FIG. 1, a counterweight m is connected with the slide 9 via a suitable cable 13 which passes over a pair of pulleys. This counterweight 13 serves to compensate for some of the dead weight of the slide 9 and the gripping arms 3.

Figure 3:
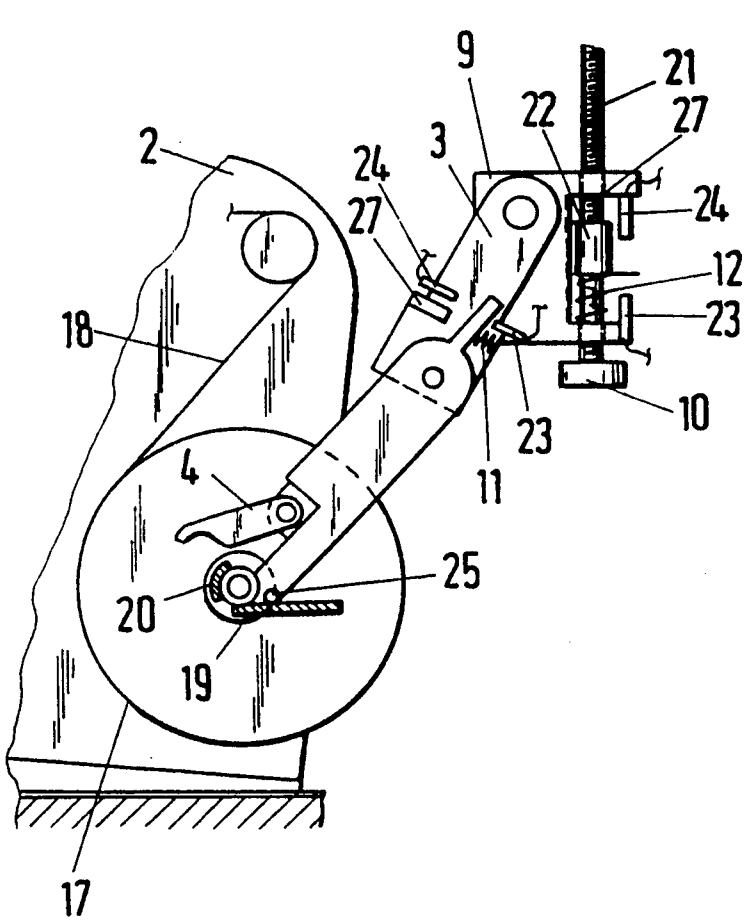
FIG. 3 illustrates a diagrammatic partial view of the changer with a gripping arm which has reached the end position on the full cloth beam.

Referring to FIGS. 1 and 2, a resilient transmission link in the form of a spring 12 is disposed in the transmission means for deflecting in response to preset limit forces being exceeded during positioning of the gripper arms 3 into a gripping position. As shown in FIG. 2, the spring 12 is disposed about the lead screw 21 between the nut 22 and the slide 9, i.e. between a stop surface 27 of the slide 9, for compressing in response to the slide 9 reaching a predetermined position corresponding to a stop position of the gripper arms. A sensing means is also provided for generating a control signal in response to a compression of the spring in order to control the further operation of the conveyor 1. As illustrated, the sensing means is in the form of a pair of sensors 23*a*, 24*a* which are mounted on the flanges of the slide 9 and parallel to the direction of movement of the nut 22 so as to sense a movement of the nut 22 relative to the slide 9, that is, a compression of the spring 12 as indicated in FIG. 3.

Referring to FIG. 2, each gripper arm 3 is made of two parts. As illustrated, one part is pivotally mounted on the slide 9 while the second part which carries the gripper elements 4 is pivotally mounted by a suitable pivot pin on the first part. In addition, a resilient transmission link in the form of a spring 11 is positioned between the two parts of the gripper arm 3 for compressing in response to the lower part reaching a predetermined position corresponding to a stop position for the gripper elements 4 (see FIG. 3). The spring 11 also cooperates with the sensing means formed of a pair of sensors 23*b*, 24*b* for generating a control signal in response to the compression spring 11. The upper part of the gripper arm 3 is also provided with a stop 27 to limit the counterclockwise movement of the lower part, as viewed.

As also illustrated in FIG. 2, the lower end of the gripper arm 3 carries a roller 25 for engaging with the rail 19 of the loom 2.

The resilient transmission links, i.e. springs 11, 12, are provided in order to compress in response to preset limit forces being overshot during a beam gripping or positioning operation.

In operation, assuming that a full cloth beam 17 is to be removed from the loom 2, the conveyor 1 is brought into a position astride the cloth beam end of the loom 2. Next, the lead screw 21 is rotated by a suitable actuating means (not shown) so as to move the gripper arms downwardly in a direction towards the rail 19 of the loom, for example, from the position shown in FIG. 1 to the position shown in FIG. 2.

As the lower end of a gripper arm 3 approaches the rail 19, the roller 25 abuts against the rail 19. When the roller 25 strikes the rail 19, the lead screw 21 continues the movement of the gripper arms 3 in the direction s (see FIG. 2). At this time, the lower part of each gripper arm 3 begins to deflect against the force of the preloaded spring 11 while the spring 11 compresses. At the same time, the spring 12 between the spindle nut 22 and the slide 9 experiences an increased loading due to the bending forces.

As the lower end of each gripper arm 3 moves into engagement with the cloth beam 17, the stop 20 on the loom 2 serves to prevent any further "bending" movement of the gripper arm 3, that is, the pivoting of the lower part of the gripper arm 3. At the same time, the stop 20 serves to prevent further downward movement of the slide 9 while the nut 22 continues to move downwardly relative to the slide 9. During this time, the spring 12 between the nut 22 and the slide 9 compresses so that the distance between the spindle nut 22 and the sensor 24 on the slide increases. A corresponding signal is then generated by the adjacent sensors 23, 24 to function as a control signal, for example, to stop further rotation of the lead screw 21.

In the event that the control signal from the sensors 23, 24 for either spring 11, 12 represents a greater value than programmed for an accurate positioning of the gripper arms 3, such may be indicative of a mis-positioning so that the operation of the changer is brought to halt and any obstruction removed to permit a subsequent accurate operation.

Figure 5:
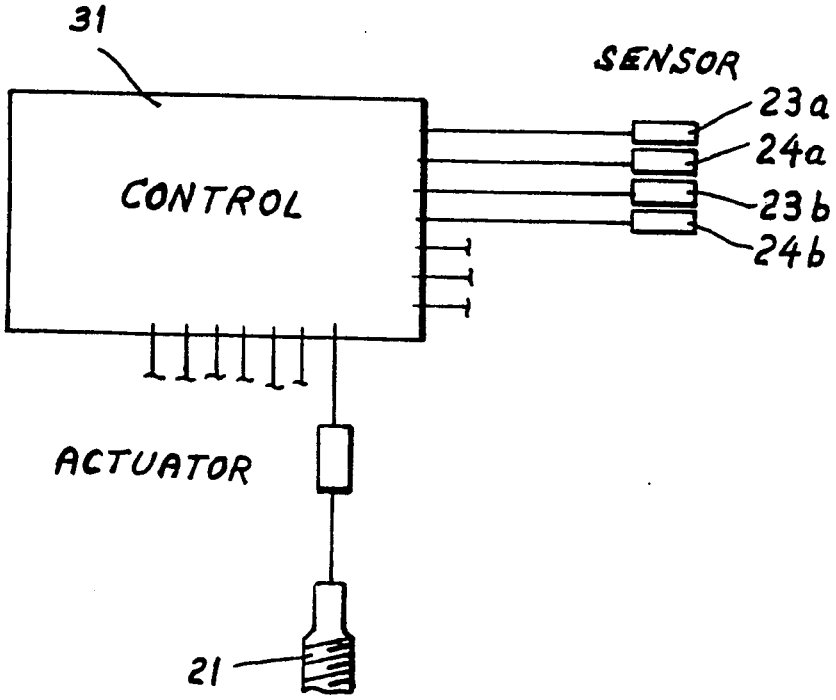
FIG. 5 diagrammatically illustrates the function of a control of a lead screw.

Referring to FIG. 5, the control signals received from the sensors 23*a*, 24*a*; 23*b*, 24*b* may be compared within a suitable control 31 so as to permit continued operation should the signal fall within a predetermined tolerance range.

The control signal which is generated by the respective sensing means may be used to inhibit further movement of the transmission means in response to a predetermined deflection of a respective spring 11, 12. Alternatively, the sensing means may be used to measure the amount of deflection of a respective spring 11, 12 and to generate a control signal in response thereto as a measure of the deflection. In either case, the control 31 for receiving and comparing the control signal with a predetermined value for the instantaneous position of the gripper arms may be used to produce a further control signal for controlling the operation of the cloth beam changer.

Figure 4:
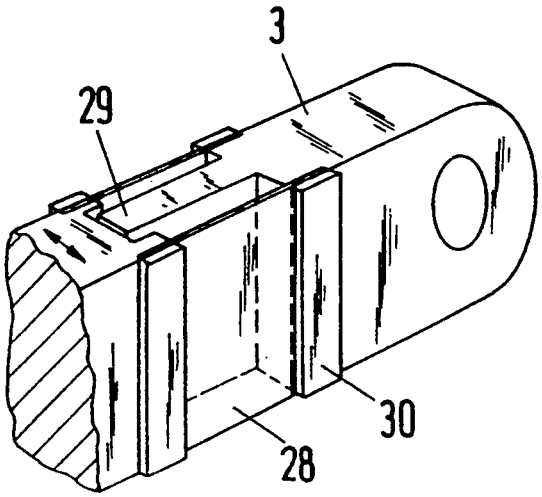
FIG. 4 illustrates a diagrammatic partial view of a gripping arm having elements facilitating displacement lengthwise of a cloth beam in accordance with the invention.

Referring to FIG. 4, each gripper arm 3 may be constructed of a pair of longitudinally spaced parts which are connected by a pair of parallel resilient plates 28, 29 secured to and between the parts. These resilient plates 28, 29 serve to flex in response to a transverse load applied to one of the gripper arm parts so as to compensate for lateral changes in positions between the gripper elements (not shown) and a cloth beam. As illustrated, the resilient plates 28 are of sheet metal and are secured by clamping strips 30 to both sides of the divided gripping arm 3 to form a parallelogram. Thus, transverse forces acting lengthwise of a cloth beam on the arm 3 cause a parallel displacement against the restoring forces of the resilient plates 28. As illustrated, one of the gripper arm parts is provided with a tongue 29 between the plates 28 so as to limit the movement of the two gripper arm parts relative to each other. When the gripper arm 3 descends and strikes the guide rail 19 (see FIG. 2) extending into the correct longitudinal position, the tongue 29 prevents further deviation, the springs 11, 12 deflect and the signals of the sensors 23 or 24 stop or reverse the movement of the gripper arms and initiate further processing of the information in the control 31.

The signals of the sensors 23, 24 are checked quite generally during the displacement of the arms 3 in the control 31 as to whether they are allowed to occur in the instantaneous position in the form in which measured and the result of the comparison is further processed as a control signal.

Referring to FIG. 1, the conveyor 1 is carried by way of external bearing or support elements 14, 15 to form a standing area large enough to take over the cloth beams 16, 17.

The invention thus provides a cloth beam changer which can accurately position the gripping elements for gripping a cloth beam as well as to position the cloth beam accurately in different stations.

The invention further provides a cloth beam changer which does not require expensive sensing mechanisms to ensure the accuracy of the positioning of the gripping elements of the changer relative to a cloth beam.

What is claimed is:

1. A cloth beam changer for a loom comprising
- a mobile conveyor;
- a pair of gripping arms mounted on said conveyor, each said arm having gripping elements for gripping a beam therebetween;
- transmission means mounted on said conveyor for moving said arms into a position for gripping the beam on said gripping elements; and
- resilient transmission links disposed in said transmission means for deflecting in response to preset limit forces being exceeded during positioning of said arms into said position.

2. A cloth beam changer as set forth in claim 1 which further comprises sensing means parallel to said resilient transmission links for generating a control signal to inhibit further movement of said transmission means in response to a predetermined deflection of a respective resilient transmission link.

3. A cloth beam changer as set forth in claim 1 which further comprises sensing means for measuring the amount of deflection of said resilient transmission links and generating a control signal in response thereto.

4. A cloth beam changer as set forth in claim 3 which further comprises a control for receiving and comparing said control signal with a predetermined value for the instantaneous position of said gripper arms to produce a further control signal.

5. A cloth beam changer as set forth in claim 1 wherein each gripper arm has a pair of longitudinally spaced parts and a pair of parallel resilient plates secured to and between said parts to connect said parts together and to flex in response to a transverse load applied to one of said parts, said one part having said gripping elements thereon.

6. A cloth beam changer as set forth in claim 1 wherein said transmission means includes a slide having said gripper arms pivotally mounted therein, a pair of supports on said conveyor, a vertically disposed rotatable lead screw passing through said slide and supported in said supports, and a nut threadably receiving said lead screw and having said slide resting thereon whereby rotation of said screw causes said nut and said slide to move vertically.

7. A cloth beam changer as set forth in claim 6 wherein said links include a first spring disposed about said lead screw between said nut and said slide for compressing in response to said slide and said gripper arms reaching a predetermined position corresponding to a stop position for said gripper arms.

8. A cloth beam changer as set forth in claim 7 wherein each arm includes a first part pivotally mounted on said slide and a second part pivotally mounted on said first part with said gripping elements at an opposite end.

9. A cloth beam changer as set forth in claim 8 wherein said links include a second spring disposed between said arm parts for compressing in response to said second part reaching a predetermined position corresponding to a stop position for said gripper elements.

10. A cloth/beam changer for a loom comprising
- a mobile conveyor for movement into a location astride a loom to effect a cloth beam exchange;
- a slide movably mounted on said conveyor along a predetermined path;
- a pair of gripping arms pivotally mounted on said slide, each said arm having gripping elements for gripping a beam therebetween upon movement into a predetermined position;
- means for moving said slide along said path to move said gripping elements into said predetermined position; and
- a spring between said means and said slide for compressing in response to preset limit forces being exceeded during positioning of said gripping elements in said predetermined position.

11. A cloth beam changer as set forth in claim 10 wherein said means includes a lead screw passing through said slide and a nut threadably receiving said screw and longitudinally guided in said slide with said slide resting thereon and wherein said spring is disposed between said nut and said slide.

12. A cloth beam changer as set forth in claim 11 wherein each arm includes a first part pivotally mounted on said slide and a second part pivotally mounted on said first part with said gripping elements at an opposite end.

13. A cloth beam changer as set forth in claim 12 which further comprises a second spring disposed between said arm parts for compressing in response to said second part reaching a predetermined position corresponding to a stop position for said gripper elements.

14. A cloth beam changer as set forth in claim 10 which further comprises a sensing means for generating a control signal in response to a predetermined deflection of said spring for controlling the operation of said conveyor.

15. A cloth beam changer as set forth in claim 10 wherein each arm includes a first part pivotally mounted on said slide and a second part pivotally mounted on said first part with said gripping elements at an opposite end.

16. A cloth beam changer as set forth in claim 15 which further comprises a second spring disposed between said arm parts for compressing in response to said second part reaching a predetermined position corresponding to a stop position for said gripper elements.

17. A cloth beam changer as set forth in claim 16 which further comprises a second sensing means for generating a control signal in response to a predetermined deflection of said spring for controlling the operation of said conveyor.

18. A cloth beam changer as set forth in claim 10 wherein each gripper arm has a pair of longitudinally spaced parts and a pair of parallel resilient plates secured to and between said parts to connect said parts together and to flex in response to a transverse load applied to one of said parts, said one part having said gripping elements thereon.

19. In combination, a loom having a cloth winding - on station including a guide rail and a stop; and a cloth beam changer including a pair of gripping arms, each arm having gripping elements for gripping a beam in said station, transmission means for moving said arms into a position with said gripping elements of at least one arm sliding on said rail and abutting said stop and resilient transmission links disposed in said transmission means for deflecting in response to preset limit forces being exceeded during sliding of said gripper elements of said one arm on said rail into abutment with said stop.

20. The combination as set forth in claim 19 which further comprises sensing means parallel to said resilient transmission links for generating a control signal to inhibit further movement of said transmission means in response to a predetermined deflection of a respective resilient transmission link.

* * * * *

UNITED STATES PATENT AND TRADEMARK OFFICE

CERTIFICATE OF CORRECTION

PATENT NO. : 5,031,666

DATED : July 16, 1991

INVENTOR(S) : TONNY RAAIJMAKERS, et al

It is certified that error appears in the above-identified patent and that said Letters Patent is hereby corrected as shown below:

Column 6, line 14 change "cloth/beam" to -cloth beam-

Signed and Sealed this

Fifth Day of January, 1993

*Attest:*

DOUGLAS B. COMER

*Attesting Officer*

*Acting Commissioner of Patents and Trademarks*